US006702434B2

(12) United States Patent
Barinaga et al.

(10) Patent No.: US 6,702,434 B2
(45) Date of Patent: Mar. 9, 2004

(54) FLUIDIC INTERCONNECT STRUCTURES

(75) Inventors: Louis C. Barinaga, Salem, OR (US); Daniel D. Dowell, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/137,522

(22) Filed: Apr. 30, 2002

(65) Prior Publication Data

US 2003/0202058 A1 Oct. 30, 2003

(51) Int. Cl.[7] ..... B41J 2/175
(52) U.S. Cl. ..... 347/85
(58) Field of Search ..... 347/85, 86, 87; 604/87, 86, 88, 905, 415

(56) References Cited

U.S. PATENT DOCUMENTS 4,516,967 A * 5/1985 Kopfer ..... 604/87
5,721,576 A * 2/1998 Barinaga ..... 347/85
5,815,182 A 9/1998 Otis et al. ..... 347/85
5,895,383 A * 4/1999 Niedospial, Jr. ..... 604/403
6,130,695 A * 10/2000 Childers et al. ..... 347/85
6,273,562 B1 * 8/2001 Deshmukh ..... 347/86

* cited by examiner

*Primary Examiner*—Anh T. N. Vo

(57) ABSTRACT

A seal septum structure includes a septum body structure fabricated of a resilient material. The body structure includes an opening formed there through and a first seal surface circumscribing the opening to engage against a needle when inserted into the opening. The body structure further includes a second seal surface for engaging against a stopper structure when the needle is not inserted into the opening. The septum structure can be over-molded on a rigid host part, or fabricated as a separate structure from the host part, and pressed in to place.

51 Claims, 6 Drawing Sheets

FLUIDIC INTERCONNECT STRUCTURES

BACKGROUND OF THE DISCLOSURE

Needle septum fluid interconnects have been employed in inkjet printing systems. These interconnects have used a molded elastomeric septum placed below a rigid chamber in which are placed a small metallic ball and a helical compression spring. A slit in the septum forms an opening for a side-hole needle to penetrate. A crimp sleeve held the septum in place.

Slitting the septum causes micro-tearing in the septum material, causing high stress when the septum is penetrated by the needle. When the needle is engaged, the ink can contact the septum, and can attack the high stress areas of the septum, leading to possible material property degradation and material set. Slitting the septum can result in jagged coarse surfaces. As the needle engages the septum, it can scrape septum material away, introducing small particles into the ink and thus contaminating the ink.

SUMMARY OF THE DISCLOSURE

A septum structure includes a septum body structure fabricated of a resilient material. The body structure includes an opening formed there through and a first seal surface circumscribing the opening to engage against a needle when inserted into the opening. The body structure further includes a second seal surface for engaging against a stopper structure assembled with the seal septum when the needle is not inserted into the opening. The septum structure can be over-molded on a rigid host part, or fabricated as a separate structure from the host part, and pressed in to place. Other embodiments are disclosed.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1:
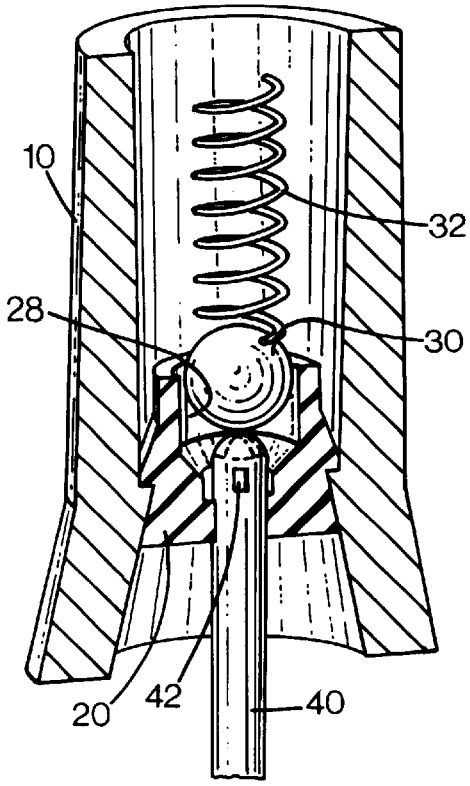
FIG. 1 is a cutaway view of an embodiment of a glandular septum structure, showing a needle in an engaged state with a seal element in the septum.
Figure 2:
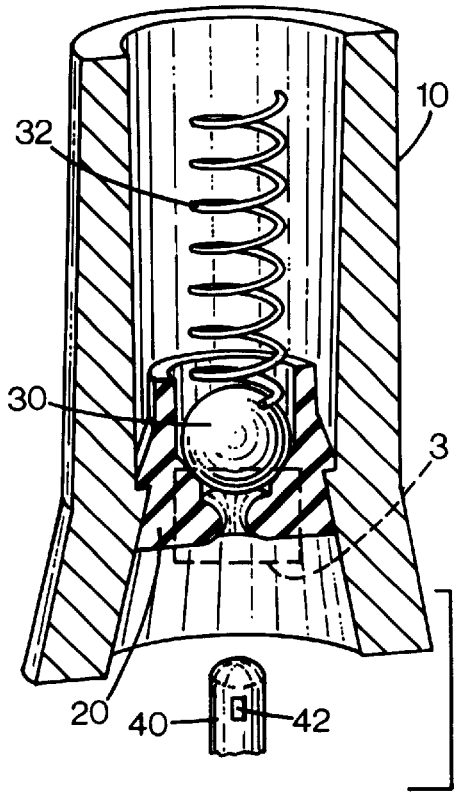
FIG. 2 is a cutaway view similar to FIG. 1, but showing the needle in a disengaged state.
Figure 3:
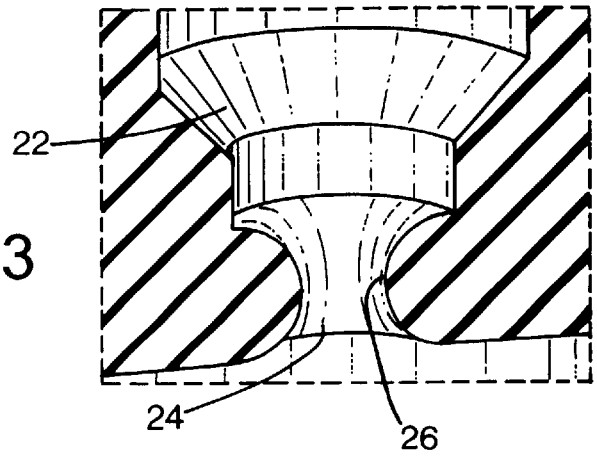
FIG. 3 is an enlarged view of a portion of the septum structure of FIG. 1, showing exemplary forms of a seal element surface and a gland seal surface.

An embodiment of a septum structure 20 is shown in FIGS. 1–3. The structure 20 forms a glandular septum pressed into a host part 10, e.g. an ink supply body. A ball 30 is urged against a top sealing surface 22 of the septum by a helical spring 32. The helical spring 32 has one end in contact with the ball, and a second end (not shown in FIGS. 1–3) which engages against a stop surface of the host part. The septum is adapted to engage with a hollow needle 40 having a side opening 42 formed therein.

The septum structure 20 provides two seals, each suitable for a different mode of operation. The first seal is a glandular seal , similar to an o-ring seal. This seal is the primary seal while the needle is engaged. This type of seal is particularly useful for use during engagement because it is a low stress seal, i.e. the material does not undergo extreme local deformations. This is in contrast to traditional slit septum designs that endure extreme local deformations while in the presence of ink. The second seal is a stopper seal that is created between the ball and the funnel shaped face of the septum. This type of seal is optimized to provide the reseal function after the needle and the septum are disengaged.

FIG. 1 is a cutaway view, illustrating the needle and septum in an engaged state. FIG. 2 is a similar view, but showing the disengaged state. FIG. 3 is an enlarged view of a portion of the septum 20, illustrating the seal surfaces. In this exemplary embodiment, the septum structure 20 is a unitary one-piece structure, injection molded of an elastomeric material such as liquid injection molded (LIM) silicon, EPDM or isoprene. The septum structure in this exemplary embodiment has a circular symmetry about its longitudinal axis. An opening 24 is formed in the septum, through which the needle can be inserted. The opening is defined by a half-toroidal-shaped gland seal surface 26 of the septum. In this exemplary embodiment, the inner diameter of the gland seal surface (analogous to the minor diameter of an o-ring) is sized relative to the outer diameter of the needle to present a 20% diametrical interference with the needle. The surface 26 engages against the needle while it is inserted to form a gland seal.

The septum 20 further includes a funnel-shaped seal surface 22 which is inclined from the longitudinal axis. The ball 30 seats against the surface 22 in the absence of the needle, under the spring bias. The seal surface 22 is at the base of a ball receptacle 28 defined by the structure 20. The receptacle 28 has a slightly larger diameter than the ball 30, and thus the ball slides up and down within the receptacle as the needle is inserted through the opening 24.

The outer surface of the septum structure 20 has a double barbed shape to fit into a complimentary shape defined in the host part 10, to secure the septum structure in place within the host part. Of course, other shapes or securing means could alternatively be employed such as adhesives. The use of a feature on the outer surface of the septum allows the septum to be secured in place without the need for adhesives or crimping structures in this embodiment.

Figure 4:
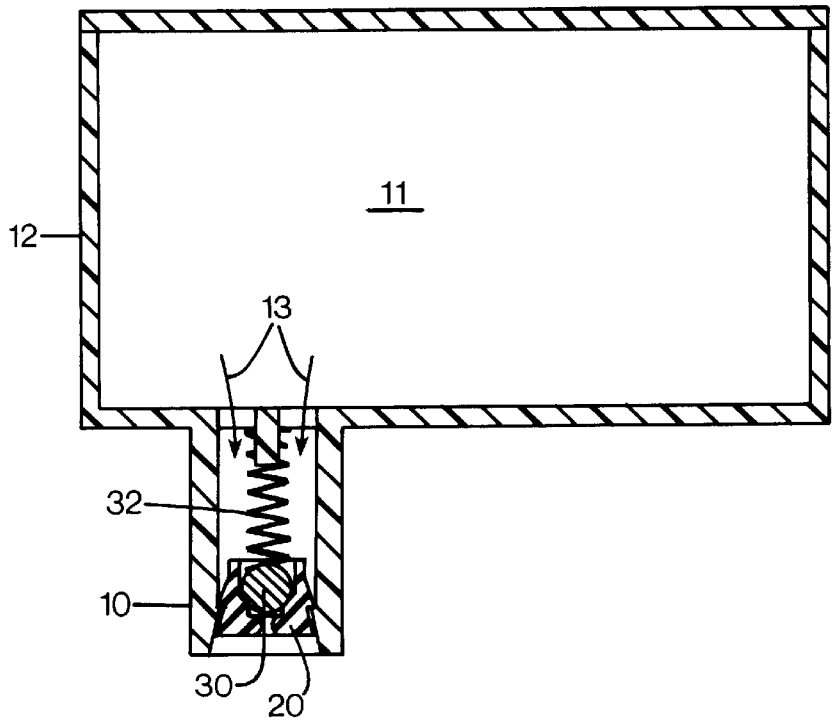
FIG. 4 is a cross-sectional diagrammatic depiction of an exemplary fluid supply employing the septum structure of FIG. 1.

FIG. 4 illustrates an exemplary structure employing the septum structure 20. In this example, the host part 10 is a fluid supply, having a housing 12 enclosing a fluid reservoir 11. The septum structure 20 is positioning in the output port for the supply, to provide an interconnect permitting fluid to pass from reservoir 11 in the direction of arrows 13, when the stopper 30 is engaged by a needle (not shown in FIG. 4) and pushed against the bias of spring 32.

Figure 5:
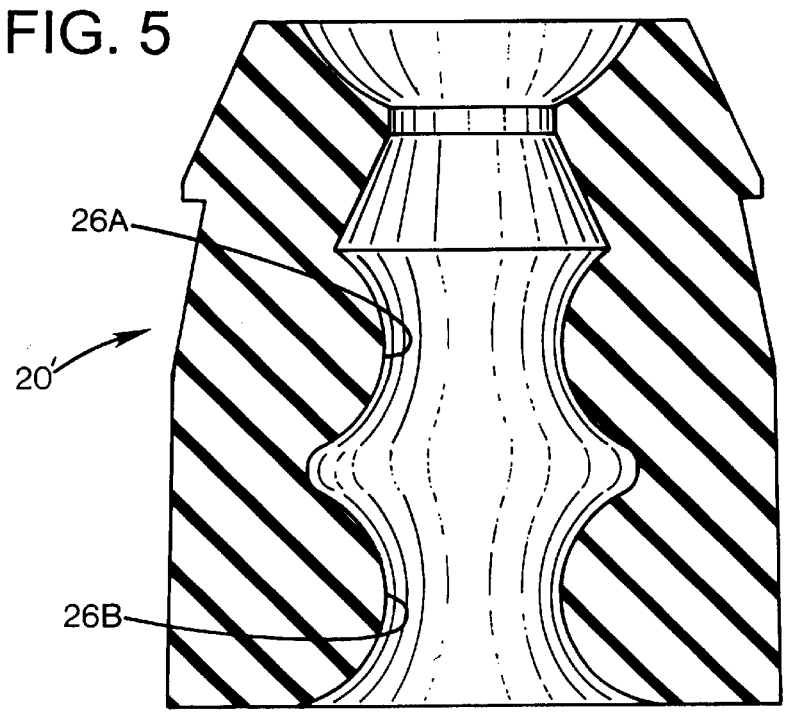
FIG. 5 is a cutaway view of an embodiment of a glandular septum structure having a double gland seal structure for sealing an engaged needle.

FIG. 5 illustrates in a cutaway view an alternate embodiment of a gland seal septum structure 20', wherein multiple gland seal surfaces 26A, 26B are provided to enhance the sealing of the needle when in the engaged position. In other respects, the structure 20' is similar to the septum structure 20 of FIGS. 1–3.

Figure 6:
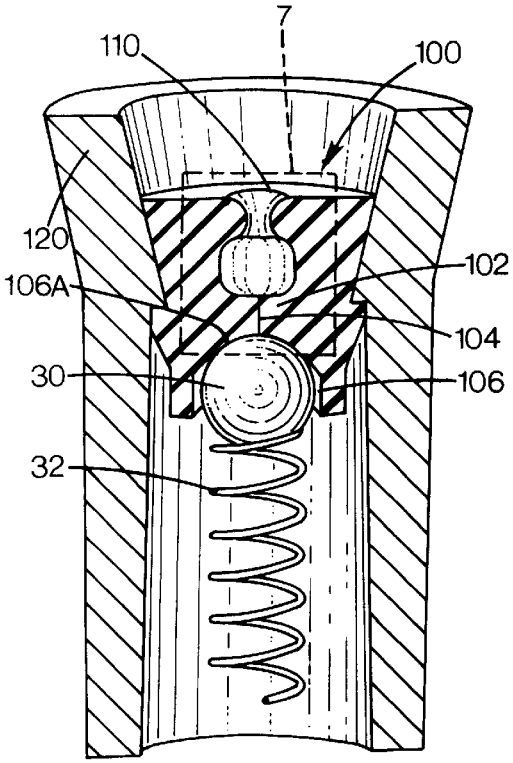
FIG. 6 is a cutaway view of an alternate embodiment of a septum structure.
Figure 7:
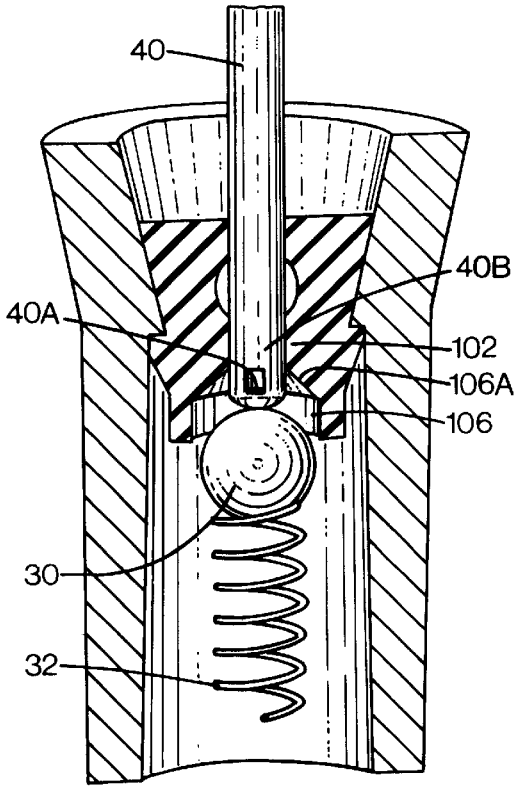
FIG. 7 is a cutaway view similar to FIG. 6, but showing the needle in an engaged state.
Figure 8:
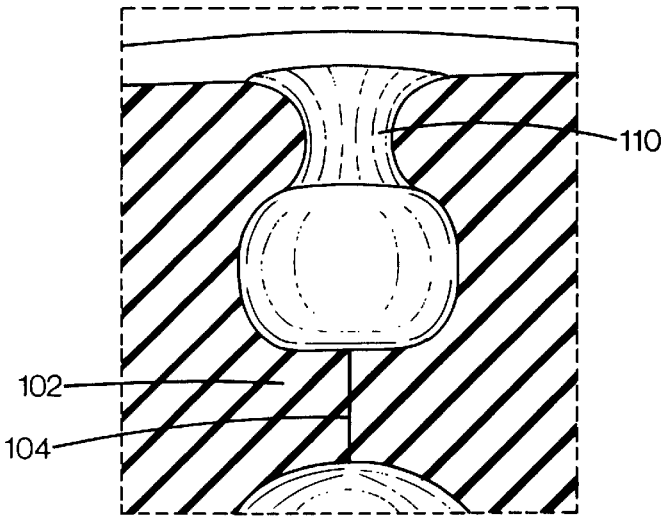
FIG. 8 is an enlarged view of a portion of the septum structure of FIG. 6.

Another embodiment of a septum structure in accordance with the invention is illustrated in FIGS. 6–8. This alternate septum structure 100 employs a slit to create the needle path through the septum structure and also employs a low stress glandular seal. This structure has a molded continuous slit membrane 102 that is slit from the bottom side, or lanced from either side, to create a slit or opening 104. Above the slit membrane 102, a gland seal feature 110 is created. This gland seal acts as a redundant seal to ensure proper seal integrity when the needle 40 is engaged, even if the septum has been in contact with ink for a long duration, and also helps to center and guide the needle before it comes into contact with the slit.

As with the septum structure 20 of FIGS. 1–3, the septum structure further includes a ball receptacle 106 into which the ball 30 is received when the interconnect needle is in a disengaged state (FIG. 6). A biasing member such as a helical spring 32 urges the ball 30 into the receptacle, sealing against the funnel face 106A to prevent fluid flow through the slit 104. When the needle 40 is positioned in the engaged state (FIG. 7), the tip 40B of the needle is inserted through the gland seal 110 and through the slit seal 104, to expose the side hole 40A formed in the needle tip 40B and allow fluid to flow through the hollow needle through the fluid interconnect.

The septum 100 in this exemplary embodiment is press fit into the host part 120, as in the embodiment of FIGS. 1–3. The outer surface of the septum structure 100 has a double barbed shape to fit into a complimentary shape defined in the host part 120, to secure the septum structure in place within the host part. The host part is fabricated of a rigid material such as an injection-molded engineering plastic, in an exemplary embodiment.

In another embodiment, the septum structure is over-molded onto a rigid substrate, the host part. The rigid substrate is produced in a first mold cavity, using injection molding techniques. This substrate is then transferred to a second mold cavity, wherein a single septum or a plurality of septa are over-molded onto the substrate to create a single part, in which case a single part, multiple-fluid interconnect structure is produced.

Figure 9:
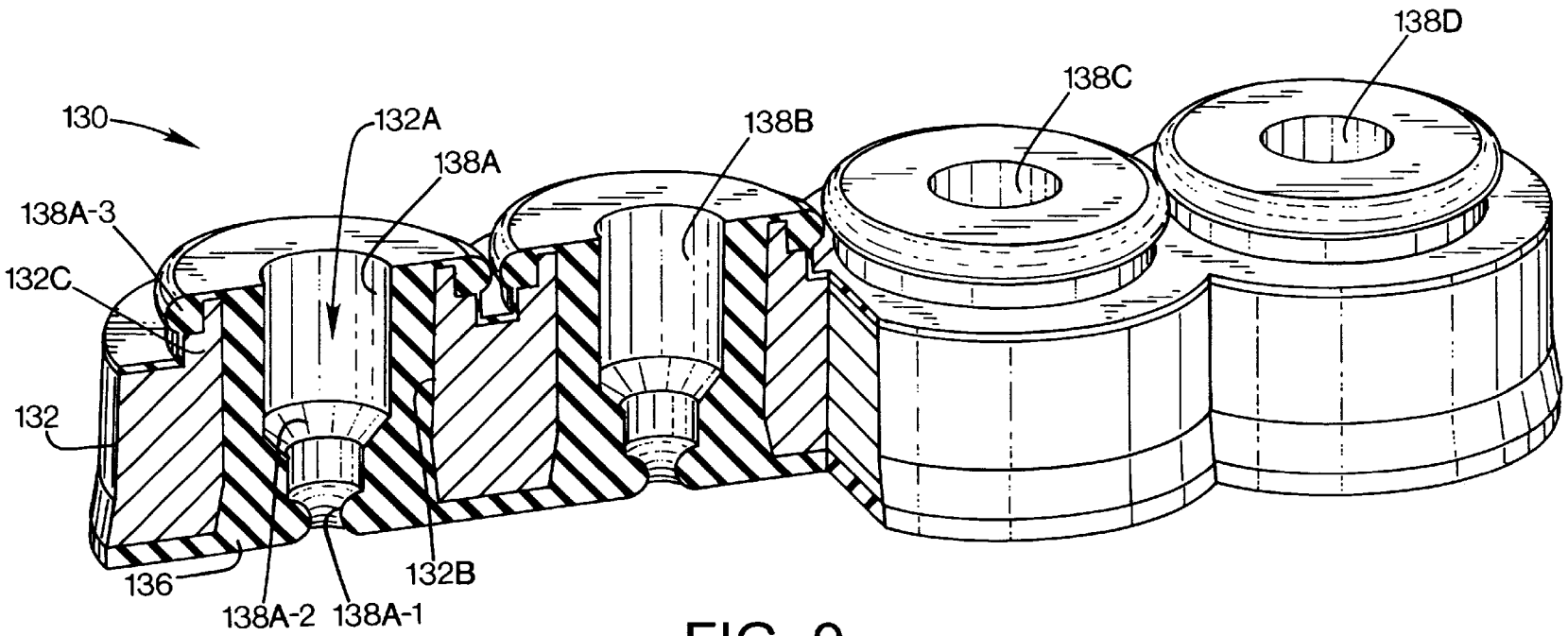
FIG. 9 is a cutaway isometric view of an embodiment of an over-molded septa structure.

FIG. 9 is a cutaway isometric view of an over-molded septa structure 130. This exemplary embodiment provides a ganged set of four septa, although in general the structure can include a single over-molded septum or many septa. The rigid substrate 132 defines a plurality of through openings, one for each septum. For example opening 132A is defined by a peripheral wall 132B, which terminates at an upper ridged lip portion 132C. An elastomeric structure 136 is over-molded over the rigid substrate to define the individual septa 138A–138D. The elastomeric structure 136 defines, for each septum, a glandular seal and a stopper seal surface for sealing against a stopper member. Septum 138A, for example, has a glandular seal 138A-1 and a funnel-shaped stopper seal surface 138A-2. The glandular seal and the stopper seal surface for the over-molded septa structures are similar to those described above with respect to the embodiment of FIGS. 1–3. The gland seal is similar to an o-ring structure, and is the primary seal while the fluid interconnect needle is engaged. The stopper seal surface with the stopper provides a seal function when the needle and septum are not engaged.

Each septum also is molded with an externally facing second glandular seal at the top of the rigid substrate wall surface for providing a seal to a host part. For example, septum 138A is formed with a glandular seal 138A-3.

Exemplary suitable materials for the rigid substrate include LCP, PPS, NORYL (TM), and high heat thermoplastics. Exemplary suitable materials for the over-molded structure include EPDM, LIM silicon, and Isoprene.

An advantage of this exemplary embodiment of an over-molded septa structure is that the septa geometry can be created during a single over-mold operation, and allows for a simple, single action mold tool without slides to create the septa features.

Figure 10:
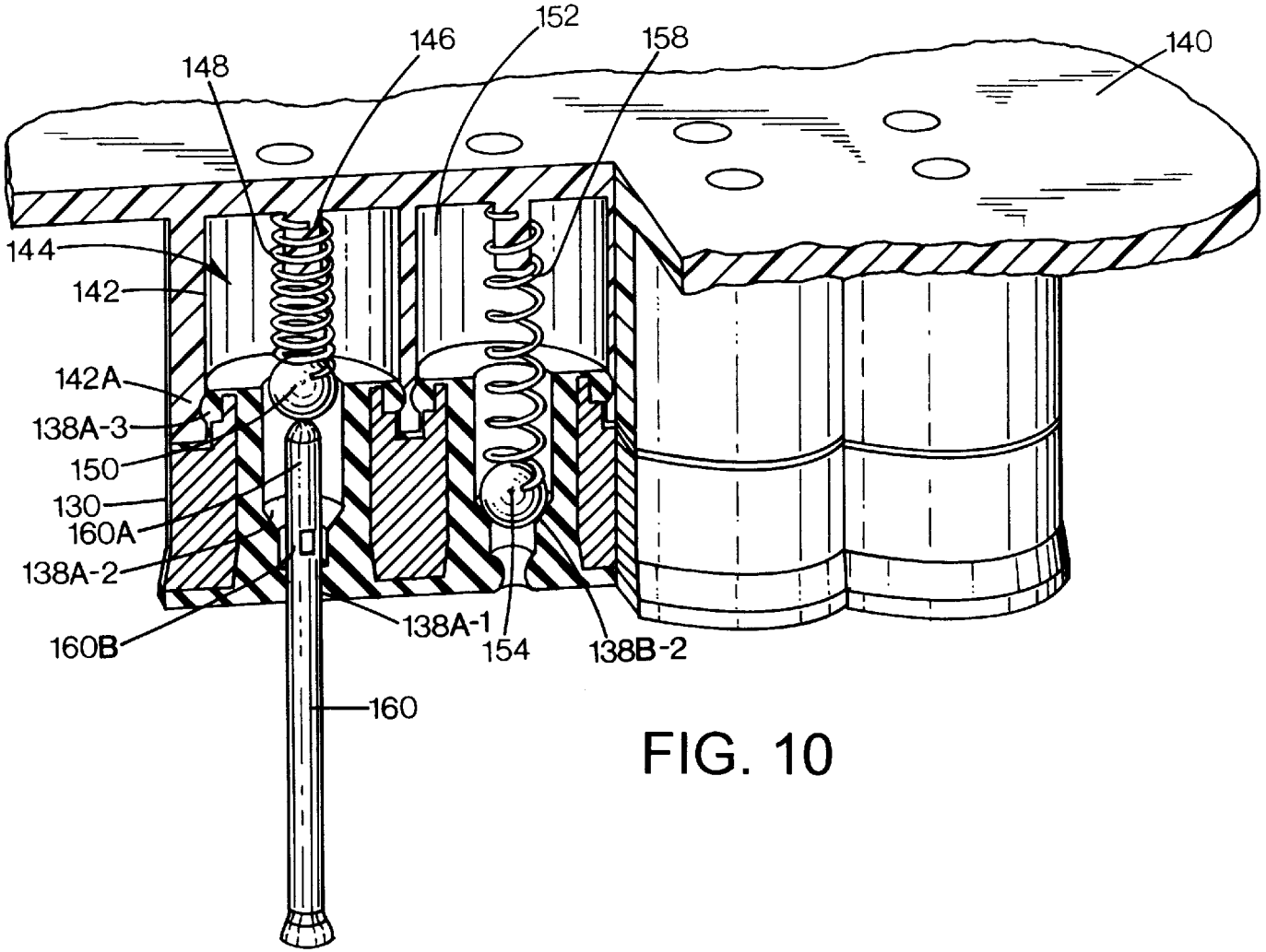
FIG. 10 is a cutaway isometric view of the septa structure of FIG. 9 after it has been mated to a host part.

FIG. 10 is a cutaway isometric view of the septa structure 130 after it has been mated to a host part 140. The host part includes a plurality of cylindrical bosses, e.g. boss 142, which define fluid chambers, e.g. chamber 144. The distal ends of the bosses engage the externally facing glandular seals formed on the septa structure to provide a fluid seal between the host part 140 and the septa structure 130. For example, the distal end 142A of boss 142 engages in a compressive relationship with seal 138A-3.

The host part 140 in this exemplary embodiment includes a top plate portion which is part of a unitary host part structure, injection molded to form the top plate portion and the bosses. The host part 140 further includes a downwardly extending pin for each chamber, e.g. pin 146 in chamber 144. The pins hold in position respective helical springs, e.g. spring 148, which bias the respective stopper elements, e.g. ball 150, for each chamber.

FIG. 10 shows a hollow needle 160 with its distal end 160A inserted into the septum 138A, to provide a fluid interconnect through the hollow needle, its side opening 160B inserted past the glandular seal 138A1. The needle tip has pushed the stopper ball 150 back and out of engagement with the funnel shaped seal surface 138A-2. Thus, fluid can flow between the hollow needle and the chamber 144. The adjacent chamber 152 is illustrated in FIG. 10 with the stopper 154 urged into a compressive face seal between the funnel shaped stopper seal surface 138B-2 and the stopper 154 by spring 158, i.e. with no needle inserted into the septum 138B.

The host part 140 in this exemplary embodiment is part of a larger assembly, e.g. a fluid manifold or a fluid supply structure, and the needle is connected to another assembly, e.g. a print cartridge. Other types of structures can employ the fluid septa 130 in other applications.

Figure 11:
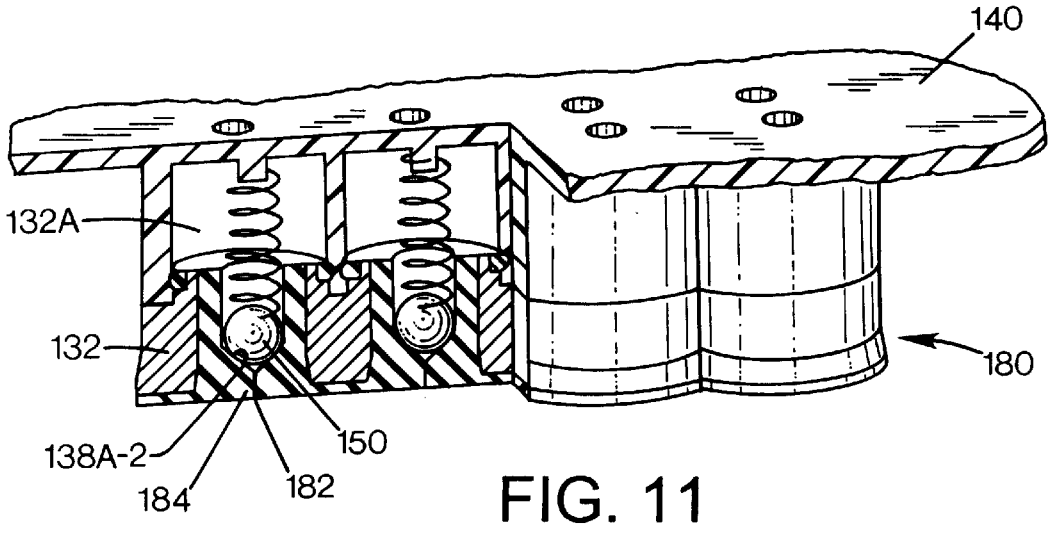
FIG. 11 is a cutaway isometric view of another embodiment of an over-molded septa structure, employing a slit in a continuous membrane at the base of the stopper receptacle to create the needle entry point and seal, illustrating the structure in a needle disengaged condition.
Figure 12:
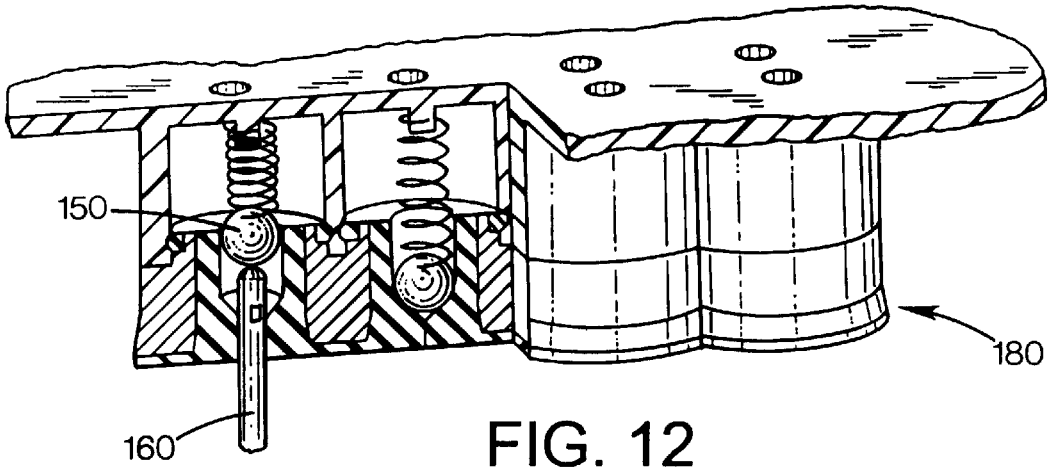
FIG. 12 is a view similar to FIG. 11, but showing the needle in an engaged condition.

FIGS. 11 and 12 illustrate another embodiment of an over-molded septa structure 180, which is assembled to the host part 140. Structure 180 is similar to structure 130 of FIGS. 9–10, except that it employs a slit 182 in a continuous membrane 184 at the base of the stopper receptacle to create the needle entry point and seal. FIG. 11 illustrates the structure in the needle disengaged condition, and FIG. 12 the needle engaged condition. Thus, in FIG. 11, the stopper ball 150 is in engagement with the stopper seal surface 138A-2, similar to the embodiment of FIGS. 9–10. In FIG. 12, the needle 160 is pressed through the slit 182. The slit surface deforms upon needle entry, creating a radial seal around the needle. The needle opening is above the membrane, allowing fluid flow through the needle.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A glandular seal septum, comprising:

a unitary septum body structure fabricated of a resilient material;

the body structure including an opening formed there through and a gland seal surface circumscribing the opening, the gland seal surface sized to engage against a needle when inserted into the opening;

the body structure further including a stopper seal surface for engaging against a stopper structure when the needle is not inserted into the opening.

2. The septum of claim 1, wherein the stopper seal surface is inclined relative to a longitudinal axis of the body structure.

3. The septum of claim 2, wherein the body structure has a circular symmetry about the longitudinal axis.

4. The septum of claim 1, wherein the stopper seal surface has a funnel shape.

5. The septum of claim 4, wherein the body structure further includes a stopper receptacle having a diameter larger than a dimension of the stopper, the stopper seal surface forming a base of the stopper receptacle.

6. The septum of claim 1, wherein the gland seal surface has a generally rounded shape.

7. The septum of claim 1, wherein the gland seal surface has a half-toroidal shape.

8. The septum of claim 1, wherein the resilient material is liquid injection molded silicon, EPDM or isophrene.

9. The septum of claim 1, wherein the body structure has an outer peripheral surface, having a barb feature to secure the septum to a host part.

10. The septum of claim 1, wherein said septum body structure is an over-molded structure molded onto a host part.

11. The septum of claim 1, wherein the gland seal surface includes a first gland seal surface portion and a second gland seal surface portion arranged along the opening to provide first and second gland seals against the needle when inserted into the opening.

12. The septum of claim 11, wherein the first gland seal portion and the second gland seal portion have half-toroidal shapes.

13. A ganged fluid interconnect structure, comprising a plurality of septa, and wherein each septum comprises the glandular seal septum of claim 1.

14. The septum of claim 1, wherein the gland seal surface has a seal diameter which is smaller than a diameter of the needle.

15. The septum of claim 14, wherein said seal diameter is sized to present a 20% diametrical interference with the needle.

16. A fluid interconnect, comprising:

an interconnect body structure having an fluid interconnect port;

a needle for connection to a fluid reservoir or fluid path;

a movable stopper structure;

a septum body structure fabricated of a resilient material and fitted into the fluid interconnect port;

the septum body structure including an opening formed there through and a gland seal surface circumscribing the opening, the gland seal surface sized to engage against the needle when inserted into the opening;

the septum body structure further including a stopper seal surface for engaging against the stopper structure when the needle is not inserted into the opening.

17. The fluid interconnect of claim 16, wherein the stopper seal surface is inclined relative to a longitudinal axis of the fluid interconnect.

18. The fluid interconnect of claim 17, wherein the septum body structure has a circular symmetry about the longitudinal axis.

19. The fluid interconnect of claim 16, wherein the stopper seal surface has a funnel shape.

20. The fluid interconnect of claim 19, wherein the body structure further includes a stopper receptacle having a diameter larger than a dimension of the stopper, the stopper seal surface forming a base of the stopper receptacle.

21. The fluid interconnect of claim 16, wherein the gland seal surface has a generally rounded shape.

22. The fluid interconnect of claim 16, wherein the gland seal surface has a half-toroidal shape.

23. The fluid interconnect of claim 16, wherein the resilient material is liquid injection molded silicon, EPDM or isoprene.

24. The fluid interconnect of claim 16, wherein the septum body structure has an outer peripheral surface, having a barb feature to secure the septum to a corresponding feature formed in the interconnect body structure.

25. The fluid interconnect of claim 16, wherein said septum body structure is an over-molded structure molded onto said interconnect body structure.

26. The fluid interconnect of claim 16, wherein the gland seal surface includes a first gland seal surface portion and a second gland seal surface portion arranged along the opening to provide first and second gland seals against the needle when inserted into the opening.

27. The fluid interconnect of claim 26, wherein the first gland seal portion and the second gland seal portion have half-toroidal shapes.

28. the fluid interconnect of claim 16, wherein the gland seal surface has a seal diameter which is smaller than a diameter of the needle.

29. The fluid interconnect of claim 28, wherein said seal diameter is sized to present a 20% diametrical interference with the needle.

30. A glandular seal septum, comprising:

a unitary septum body structure fabricated of a resilient material;

the body structure including an opening formed there through and a gland seal surface circumscribing the opening, the gland seal surface sized to engage against a needle when inserted into the opening;

the body structure further including a stopper seal surface for engaging against a stopper structure when the needle is not inserted into the opening; and wherein said septum body structure further includes a membrane having a slit formed there through to define a slit surface, the slit surface deforming about the needle when inserted through the slit and forming a redundant radial seal about the needle.

31. A fluid interconnect, comprising:

an interconnect body structure having an fluid interconnect port;

a needle for connection to a fluid reservoir or fluid path;

a movable stopper structure;

a septum body structure fabricated of a resilient material and fitted into the fluid interconnect port;

the septum body structure including an opening formed there through and a gland seal surface circumscribing the opening, the gland seal surface sized to engage against the needle when inserted into the opening;

the septum body structure further including a stopper seal surface for engaging against the stopper structure when the needle is not inserted into the opening; and wherein said septum body structure further includes a membrane having a slit formed there through to define a slit surface, the slit surface deforming about the needle when inserted through the slit and forming a redundant radial seal about the needle.

32. A fluid interconnect structure, comprising:

a rigid interconnect body structure having an fluid interconnect port;

a septum body structure fabricated of a resilient material and over-molded onto the fluid interconnect port;

the septum body structure defining a first seal surface to engage against a needle when inserted into the opening;

the septum body structure further including a second seal surface for engaging against a fluid interconnect stopper structure when the needle is not inserted into the opening.

33. The fluid interconnect structure of claim 32, wherein the second seal surface is inclined relative to a longitudinal axis of the fluid interconnect.

34. The fluid interconnect structure of claim 33, wherein the septum body structure has a circular symmetry about the longitudinal axis.

35. The fluid interconnect structure of claim 32, wherein the second seal surface has a funnel shape.

36. The fluid interconnect structure of claim 35, wherein the body structure further includes a stopper receptacle having a diameter larger than a dimension of the stopper structure, the second seal surface forming a base of the stopper receptacle.

37. The fluid interconnect structure of claim 32, wherein said septum body structure further includes a membrane having a slit formed there through to define the first seal surface deforming about the needle when inserted through the slit and forming a radial seal about the needle.

38. The fluid interconnect structure of claim 32, wherein the first seal surface is a gland seal surface.

39. The fluid interconnect structure of claim 38, wherein the gland seal surface has a half-toroidal shape.

40. The fluid interconnect structure of claim 32, wherein the resilient material is liquid injection molded silicon, EPDM or isoprene.

41. The fluid interconnect structure of claim 32, wherein the septum body structure further including a third seal surface for sealing engaging a rigid part to which the fluid interconnect part is assembled.

42. The fluid interconnect structure of claim 41, wherein said third seal surface is a gland seal surface.

43. A ganged fluid interconnect structure, comprising:

a rigid interconnect body structure defining a plurality of fluid interconnect ports;

a septa body structure fabricated of a resilient material and over-molded onto each of the fluid interconnect ports;

the septum body structure defining a plurality of septa, each septum including a first seal surface to engage against a needle when inserted into the opening and a second seal surface for engaging against a fluid interconnect stopper structure when the needle is not inserted into the opening.

44. The structure of claim 43, wherein the second seal surface is inclined relative to a longitudinal axis of the fluid interconnect.

45. The structure of claim 44, wherein the septum body structure has a circular symmetry about the longitudinal axis.

46. The structure of claim 43, wherein the second seal surface has a funnel shape.

47. The structure of claim 43, wherein each septum further includes a stopper receptacle having a diameter larger than a dimension of the stopper structure, the second seal surface forming a base of the stopper receptacle.

48. The structure of claim 43, wherein each septum further includes a membrane having a slit formed there through to define the first seal surface deforming about the needle when inserted through the slit and forming a radial seal about the needle.

49. The structure of claim 43, wherein the first seal surface is a gland seal surface.

50. The structure of claim 49, wherein the gland seal surface has a half-toroidal shape.

51. The structure of claim 43, wherein the resilient material is liquid injection molded silicon, EPDM or isoprene.

* * * * *